United States Patent [19]

Lindsey

[11] 4,225,984

[45] Oct. 7, 1980

[54] PORTABLE THERAPEUTIC WATER MASSAGE MECHANISM

[76] Inventor: Donnie R. Lindsey, P.O. Box 6428, Baytown, Tex. 77520

[21] Appl. No.: 27,526

[22] Filed: Apr. 5, 1979

[51] Int. Cl.[3] ..... A47K 3/10; A61H 9/00

[52] U.S. Cl. ..... 4/541; 4/544; 128/66

[58] Field of Search ..... 4/181, 180, 150, 145, 4/178, 166, 7; 128/66, 369

[56] References Cited

U.S. PATENT DOCUMENTS

| | | | |
|---|---|---|---|
| 1,343,892 | 6/1920 | Bagnulo | 4/150 |
| 1,896,938 | 2/1933 | Borowsky | 4/180 |
| 2,793,372 | 5/1957 | Hohman | 4/178 |
| 2,993,213 | 7/1961 | Carroll | 4/181 |
| 3,263,678 | 8/1966 | Everston | 4/180 X |
| 3,267,836 | 8/1966 | Brady | 4/180 X |
| 3,420,226 | 1/1969 | Berry, Sr. | 4/178 X |
| 4,099,272 | 7/1978 | Sowder | 4/181 X |
| 4,099,522 | 7/1978 | Alenares | 128/66 |

*Primary Examiner*—Henry K. Artis
*Attorney, Agent, or Firm*—Guy E. Matthews

[57] ABSTRACT

A portable therapeutic water massage mechanism according to this invention is adapted for utilization in conjunction with conventional bathtubs, such as are typically found in homes and hotels. A pump of the mechanism is adapted to be located outside of the bathtub, if desired, and communicates pressurized water from the bathtub to a pair of longitudinal water distribution conduits adapted to be located along each of the inside side walls of conventional bathtubs. Therapeutic massage nozzles are positioned in spaced relation along the water distribution conduits and function to direct massaging jets of water toward specific parts of the anatomy of a person within a bathtub.

10 Claims, 8 Drawing Figures

PORTABLE THERAPEUTIC WATER MASSAGE MECHANISM

FIELD OF THE INVENTION

This invention relates generally to water massage mechanisms such as are typically utilized to develop turbulent water currents in bathtubs for therapeutic and/or muscle relaxing water massage. More specifically, the present invention is directed to a portable water massage mechanism that may be utilized in conjunction with conventional bathtubs and which may be easily transported, allowing utilization of the mechanism at differing locations by the user.

BACKGROUND OF THE INVENTION

Water massage mechanisms are ordinarily provided as a part of the physical construction of a bathtub or vessel and generally incorporate a pumping system that obtains water from the tub or vessel and pumps such water at relatively high velocity, causing the water to emerge at one or more outlet openings constructed in the tub or vessel. Water massage mechanisms have found favor for therapeutic purposes in that patients requiring water massage therapy for treatment of anomalies of the joints, muscles, etc. can be treated therepeutically simply by resting within the water of the tub or vessel. The high velocity water emerging from the openings in the tub or vessel create turbulence in the water, causing the heat of the water to be more readily absorbed by the body of the patient. In some cases, patients are required to have therapeutic water massage treatment on a daily basis and such requirement restricts travel of the patient because water massage devices are not typically provided by commercial lodging establishments. It is desirable, therefore, to provide therapeutic water massage mechanisms that can be easily transported for utilization by patients requiring water massage therapy and also for utilization by persons desiring the relaxing effects of water massage systems while traveling.

Water massage devices have been developed for utilization in conjunction with conventional bathtubs and are generally constructed to locate a water outlet portion thereof at one end of conventional bathtubs, i.e. typically the bathtub end having water outlets and a drain. These devices are not considered truly portable but are merely designed for utilization in conjunction with conventional bathtubs, thus providing low cost water massage systems that are not permanent parts of the bathtub structure. In all known water massage devices utilized in conjunction with conventional bathtubs, water tubulence is created by water jets within the bathtub merely for the purpose of creating turbulent circulation of water within the bathtub, thus enhancing the heat transfer from the water to the person in the bathtub.

For therapeutic purposes, it is frequently desired that specific portions of the anatomy of patients be subjected to massaging for therapeutic purposes. For example, where water massage therapy is desired for treatment of joint problems involving the knees of a patient, it is desirable that localized water massaging be accomplished in order to obtain effective treatment of desired parts of the anatomy without adversely affecting other parts thereof. Since most presently available water massage systems of both static and portable nature merely create water turbulence in a bathtub or vessel, obviously localized water massage therapy is not possible when utilizing presently available water massage systems.

Accordingly, it is a primary feature of the present invention to provide a novel therapeutic water massage mechanism that is of portable nature and enables the user to obtain localized therapeutic massaging as desired.

It is also a feature of the present invention to provide a novel portable therapeutic water massage mechanism that may be simply and efficiently transported by the user in order to enable use of the mechanism in homes, commercial lodging establishments, etc. during travel.

It is also a feature of the present invention to provide a novel portable therapeutic water massage mechanism enabling the user to direct one or several high velocity jets of water at specific, desired parts of the human anatomy through selected control of water jets.

Among the several features of the present invention is noted the contemplation of a novel therapeutic water massage mechanism wherein a pair of spaced water distribution conduits are utilized for location along the inside side walls of conventional bathtubs enabling a person to repose between the water distribution conduits and wherein a plurality of water jets are spaced along the length of the water distribution conduits for the purpose of simultaneously directing jets of water at various selected parts of the anatomy on each side of the person reposing within the bathtub.

It is another feature of the present invention to provide a novel portable water massage mechanism that requires no structural connection to a conventional bathtub or vessel, thus enabling the mechanism to be very simply installed and removed from the bathtub or vessel as desired.

Also included among the various features of this invention is the provision of a novel portable water massage mechanism that may be simply and efficiently broken down into sectional parts for ease of transporting during travel.

It is also a feature of this invention to provide a novel therapeutic water massage mechanism whereby the suction or discharge lines of the pump mechanism may be provided with an inline heating device in order to insure that the water exiting the water distribution jets is maintained at desired temperature for the purposes involved.

An even further feature of this invention is the provision of a novel therapeutic water massage mechanism that is of simple nature, is reliable in use and is low in cost.

Other and further objects, advantages and features of the invention will become obvious to one skilled in the art upon an understanding of the illustrative embodiments about to be described and, various advantages, not referred to herein, will occur to one skilled in the art upon employment of the invention in practice.

SUMMARY OF THE INVENTION

The present invention is directed to a portable therapeutic water massage mechanism for use in conjunction with conventional bathtubs and bath vessels. The mechanism comprises an electrically energized pump that may be located outside of the bathtub, if desired, or may be located in submerged condition within the bathtub. In either case, the pump is provided with a suction conduit or opening in communication with water located in the bathtub or vessel. The pump also is provided with a water discharge conduit that conducts high velocity flow of water from the pump to a pair of longitudinal water distribution conduits that are adapted for location along the inside side walls of a conventional bathtub or bath vessel. Ordinarily, the conduits will rest on the bottom surface of the bathtub structure and will not be physically interconnected with the bathtub structure in any way. In one embodiment of the invention, the discharge conduit of the pump is branched with branch lines being connected to each of the water distribution conduits. In another embodiment, the water discharge conduit of the pump is communicated with a manifold conduit with the extremities of the manifold conduit being communicated with each of the water distribution conduits.

A plurality of water distribution jets are located in spaced relation along the length of each of the water distribution conduits and direct high velocity jets of water inwardly toward the center of the bathtub or toward the patient or person located within the bathtub. The water distribution jets are positioned so as to bring localized therapeutic, jet induced turbulence to bear upon specific parts of the anatomy of the person or patient within the bathtub. For example, certain ones of the nozzles may direct high velocity jets of water toward the ankles of a person or patient reposing within the bathtub. Other nozzles may direct jets of water toward the knees or hips of the person, as desired. Each of the nozzles may remain open at all times, if desired, or may be provided with flow restricting or blocking devices such as valves or flow control devices for the purpose of allowing the user to selectively control the jets of water that are being directed at specific portions of the anatomy. By controlling the velocity and by selectively controlling the jets, the patient or person can achieve desired therapeutic or relaxing activity of the water massage mechanism.

For portability, the water distribution conduits may be provided with one or more quick disconnect type joints, enabling the user to quickly and simply assemble or disassemble the water distribution conduits. When disassembled, the broken down water distribution conduits and the pump mechanism may be placed within a convenient, luggage size transporting container, allowing the user to transport the water massage mechanism in the same manner as an ordinary piece of luggage.

It may also be desirable to insure that the jets of water emerging from the nozzles are maintained at optimum therapeutic temperature. In this event, an inline heat source may be interconnected within the discharge or suction conduits of the pump and may be thermostatically controlled to heat the pumped water as desired.

BRIEF DESCRIPTION OF THE DRAWINGS

In order that the manner in which the above-recited advantages and objects of the present invention are attained as well as others which will become apparent can be understood in detail, a more particular description of the invention briefly summarized above may be had with reference to the specific embodiments thereof that are illustrated in the appended drawings, which drawings form a part of this specification. It is to be understood, however, that the appended drawings illustrate only typical embodiments of the invention and, therefore, are not to be considered limiting of its scope, for the invention may admit to other equally effective embodiments.

In the Drawings

DETAILED DESCRIPTION OF PREFERRED EMBODIMENTS

Figure 1:
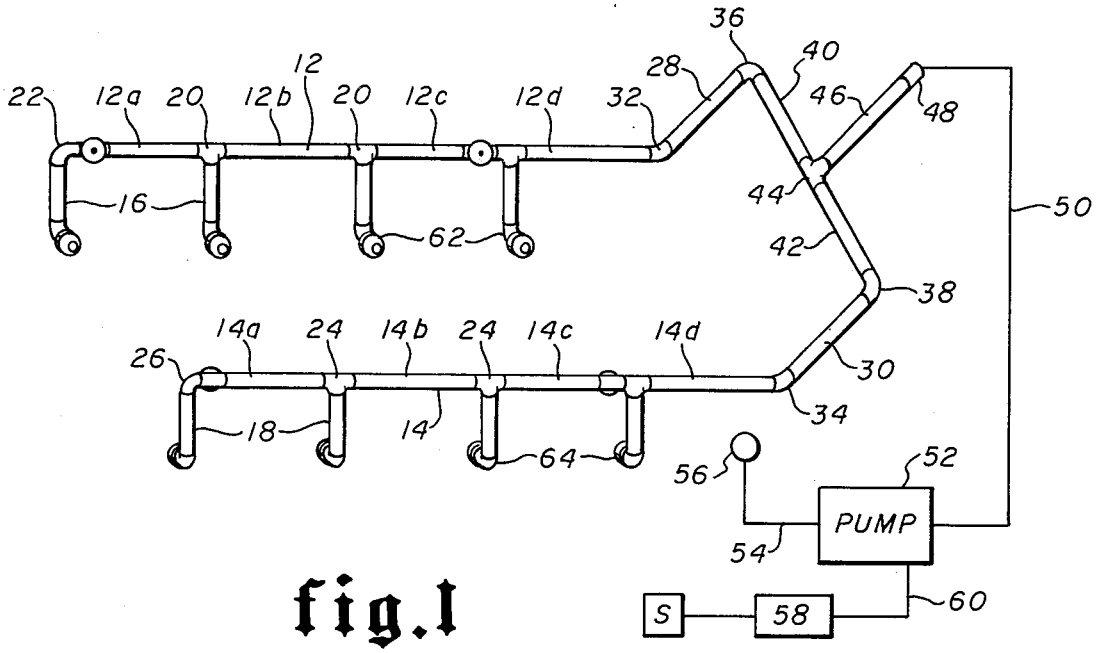
FIG. 1 is an isometric view of a portable water massage mechanism constructed in accordance with the present invention and having a portion thereof illustrated schematically.

Referring now to the drawings and first to FIG. 1, a portable therapeutic water massage mechanism is illustrated generally at 10 and comprises a water distribution portion adapted to be located within a conventional bathtub and a water supply portion adapted to be located outside of the bathtub. The water distribution portion is shown structurally in FIG. 1 while the water supply portion is illustrated schematically. The water distribution portion of FIG. 1 includes a pair of elongated water distribution conduits 12 and 14 having connected in communication therewith a plurality of depending conduits, such as shown at 16 and 18, respectively. Water distribution conduit 12 may be composed of conduit sections **12*a*, 12*b*, 12*c* and 12*d* with the conduit sections being interconnected by tee fittings 20 intermediate the extremities thereof and an elbow fitting 22 at the free extremity. Likewise, water distribution conduit 14 is composed of conduit sections 14*a*–14*d* being interconnected by tee fittings 24 and an elbow fitting 26. To simplify manufacture, the water supply conduit sections the tee and elbow fittings as well as the depending sections 16 and 18 may be composed of plastic conduit and conduit fittings such as are commercially available and widely used in the plumbing industry. Water distribution conduits 12 and 14 are connected respectively to riser conduits 28 and 30 by means of 45° elbow connections 32 and 34. The 45° elbow connections position the riser conduits 28 and 30** at a similar angle as compared to one of the end walls of a conventional bathtub in the manner illustrated in FIG.

2. The water supply conduit structure therefore generally fits the configuration of a conventional bathtub and is simply placed within the bathtub for use. The water distribution conduit structure may be secured within the bathtub, if desired, by means of a plurality of suction cups 31 that are clamped or otherwise connected to the various conduit sections 122, 124, 126 and 128.

At the upper extremities of each of the riser conduits 28 and 30 are provided 90° elbow connectors 36 and 38 that are in turn interconnected with transverse manifold conduit sections 40 and 42. The manifold conduit sections are interconnected by means of an intermediate tee connector 44 having a water supply conduit section 46 extending therefrom. A conduit connector 48 is provided to establish connection between the water supply conduit section 46 and a water discharge conduit 50 extending from a water pump 52. The pump 52 is particularly an electrically driven pump having a suction conduit 54 that terminates at a suction orifice device 56 that is placed in submerged condition within the bathtub in order that water from the bathtub may be drawn into the pump for pressurized circulation. An electrical control circuit 58 is interconnected with a control conductor 60 in order to supply the pump motor with controlled electrical energy from an electrical power source S.

At the lower extremities of each of the depending water distribution conduits 16 and 18 are provided a plurality of water distribution nozzles such as shown at 62 and 64. These nozzles generally restrict the flow of pressurized water from the depending conduit sections 16 and 18 and thereby provide high velocity flow that induces localized turbulence in the water within which the nozzles are submerged.

Figure 2:
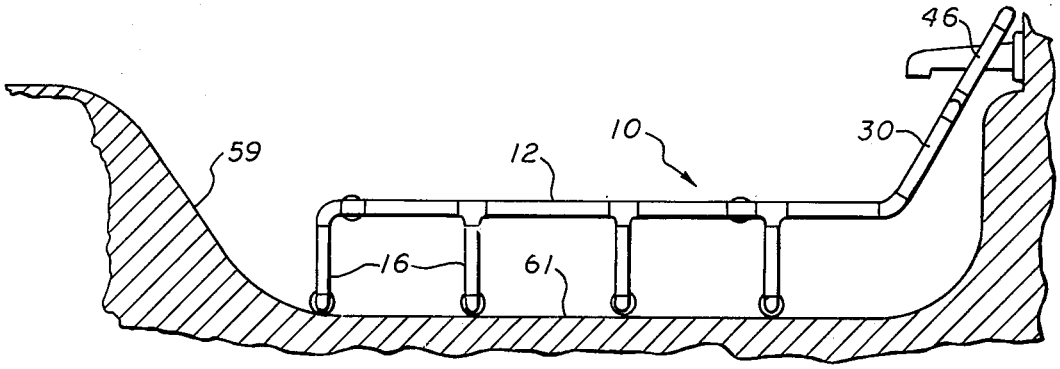
FIG. 2 is a longitudinal sectional view illustrating the inside surfaces of a conventional bathtub and showing the portable therapeutic water massage mechanism of FIG. 1 resting within the bathtub in position for use.

Referring now to FIG. 2, the water distribution portion of the water massage mechanism of this invention is shown to be resting within a conventional bathtub 59 with the lower portions of depending conduit sections 16 and 18 resting upon the lower surface 61 of the bathtub. It is evident that the water massage device of this invention may be simply lowered into the bathtub whereupon it assumes a proper relationship with the bathtub structure without any structural attachment thereto. The sidewall surfaces of the bathtub provide the water distribution conduit and the depending water distribution conduit sections with appropriate support to resist movement due to reaction forces developed by the water jets.

Figure 3:
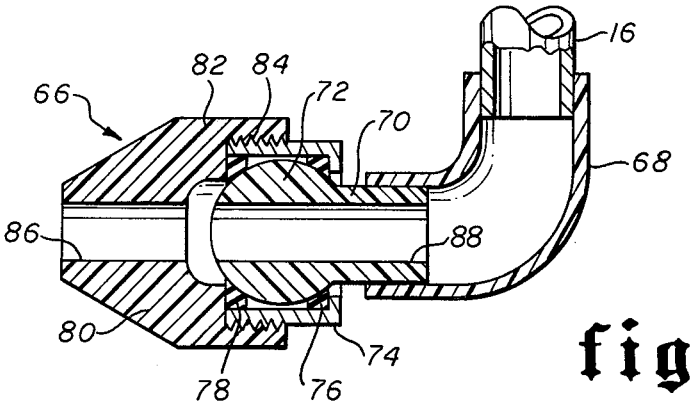
FIG. 3 is a sectional view of an adjustable nozzle construction allowing the user to adjust the direction of the water jet to facilitate optimum therapeutic use.

It may be desirable to provide for individual angular adjustment of the nozzles 62 and 64 in order to accurately direct jets of water toward specific desired portions of the anatomy of the user. In this event, a nozzle construction may conveniently take the form illustrated in FIG. 3 where an adjustable nozzle construction is illustrated generally at 66. A conventional 90° elbow connection 68 may be secured in any desired manner to the lower extremity of one of the depending water distribution conduit sections 16 or 18. A connection extremity 70 of an internal spherical element 72 may be secured within the outlet opening of the elbow connection 68. A housing structure 74 surrounds the spherical elements 72 and secures a pair of spaced internal sealing elements 76 and 78 in sealing engagement with the external spherical surface of element 72. A nozzle outlet portion 80 also defines a part of the housing 74 and includes an internally threaded connector portion 82 adapted to be received by an externally threaded portion 84 of the housing 74. The nozzle element 80 is formed to define an internal outlet passage 86 that is disposed in fluid communication with an internal passage 88 of the spherical element 72. To achieve optimum therapeutic activity the user merely adjusts the angular relationship of element 80 relative to the internal spherical element 72 thereby orienting outlet passage 86 so as to develop localized jet induced water turbulence as desired. It should also be borne in mind that the jet devices 62 and 64 may be fixed, if desired, thereby promoting the inexpensive nature of the water massage mechanism.

Figure 4:
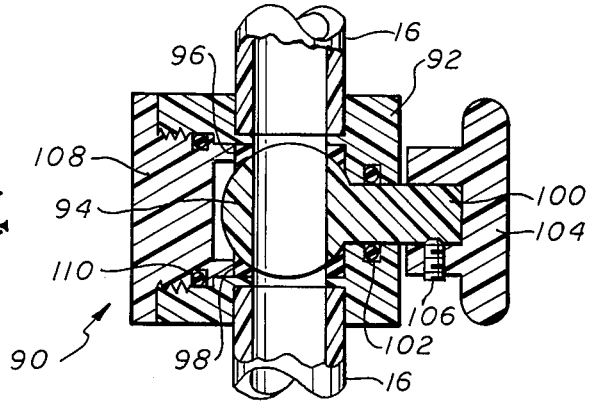
FIG. 4 is a sectional view illustrating a ball valve construction utilized for velocity control and cut off of water emerging from various ones of the water distribution jets.

It may also be desirable to control the flow of water through specific ones of the jets 62 and 64 so that some of the jets operate at full velocity, some at reduced velocity and some jets are completely cut off, as desired. Each of the depending water distribution conduit sections 16 and 18 may be provided with a flow control mechanism, such as shown in FIG. 4, the flow control mechanism being a conventional ball valve illustrated generally at 90. The ball valve may be located in conduits 16 and 18 immediately above the various nozzles provided at the lower extremities thereof. The ball valve construction includes a valve body structure 92 defining an internal valve chamber within which is received a spherical valve element 94 that is sealed with respect to the body structure by means of a pair of annular ring-like sealing elements 96 and 98. A valve stem element 100 that may be formed integrally with the valve element 94 extends upwardly through an opening in the body and is sealed with respect to the valve body by means of an annular O-ring type stem sealing element 102. A manual valve operator device such as an operator vane 104 may be secured to the valve stem 100 by means of a set screw 106 or any other suitable securing device. A bonnet structure 108 may be threadedly received within an opening formed in the valve body in order to define a removable closure that allows insertion of the various valve elements and removal of the same for repair. An annular sealing element, such as an O-ring 110, may be received within the bonnet structure in order to establish a fluid tight seal between the bonnet and body.

The valve structure 90 may be utilized to allow full open flow through a selected nozzle or, by adjusting the position of the vane-type valve actuator 104, the internal spherical valve element 94 may be placed in throttling position to restrict flow of water from the nozzle. The valve element may also be placed at a fully closed position in the event it is desired that no water flow from a respective one of the jets.

Figure 5:
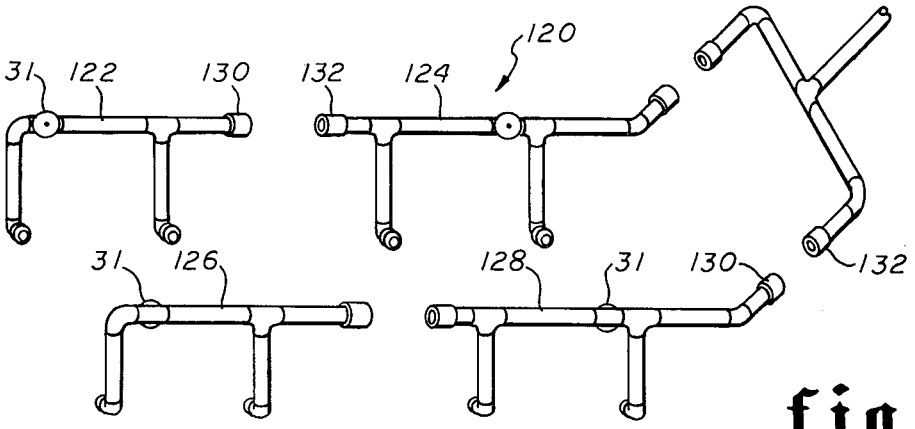
FIG. 5 is a broken isometric view illustrating the disassembled components of a water massage mechanism representing a modified embodiment of the present invention.

As mentioned above, it is desirable to provide a portable therapeutic water massage mechanism in order that patients may simply and efficiently transport the mechanism from place to place, thereby allowing the patient a freedom of travel even though the patient may be required to undergo water massage therapy on a daily basis. As shown in FIG. 5, the water distribution portion of a water massage device 120 is shown representing a modified embodiment of the present invention. Conduit sections 122, 124, 126 and 128 may be provided with quick disconnect elements such as shown at 130 and 132. The quick disconnect elements 130 and 132 may be simply assembled and disassembled in order to allow the user to assemble or disassemble the water distribution conduits in simple, quick and efficient manner. The water distribution conduit sections 122 - 126 may be of such size as to be received efficiently within a luggage sized transporting enclosure, and the pump with its suction and discharge conduits may also be received within the same container. Thus, the user is enabled to efficiently transport the therapeutic water massage mechanism from place to place as desired and is enabled to quickly assemble the mechanism for use or disassemble the mechanism for transportation.

Figure 6:
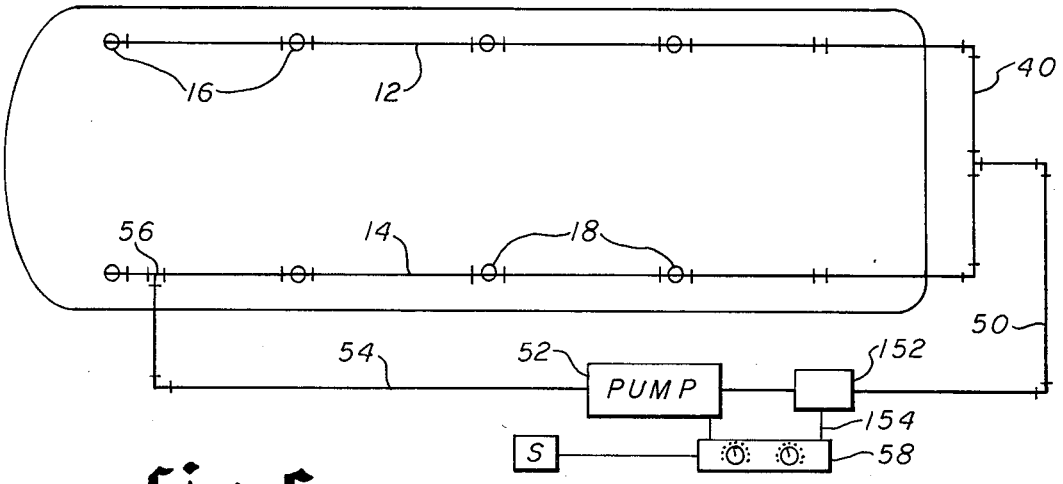
FIG. 6 is a plan view of a conventional bathtub having the portable therapeutic water massage mechanism of FIG. 1 located therein and schematically illustrating the water supply circuitry and electrical circuitry thereof.

As illustrated in FIG. 6, the mechanism of FIGS. 1–5 is shown to be resting within a conventional bathtub. The pump and its suction and discharge conduits are shown to be located outside of the bathtub and the electrical control system for the pump is also located outside the bathtub. The construction illustrated in FIG. 6 is generally preferred because it reduces the likelihood that the user might be subjected to an electrical shock resulting from a malfunction of the electrical portion of the mechanism.

Figure 7:
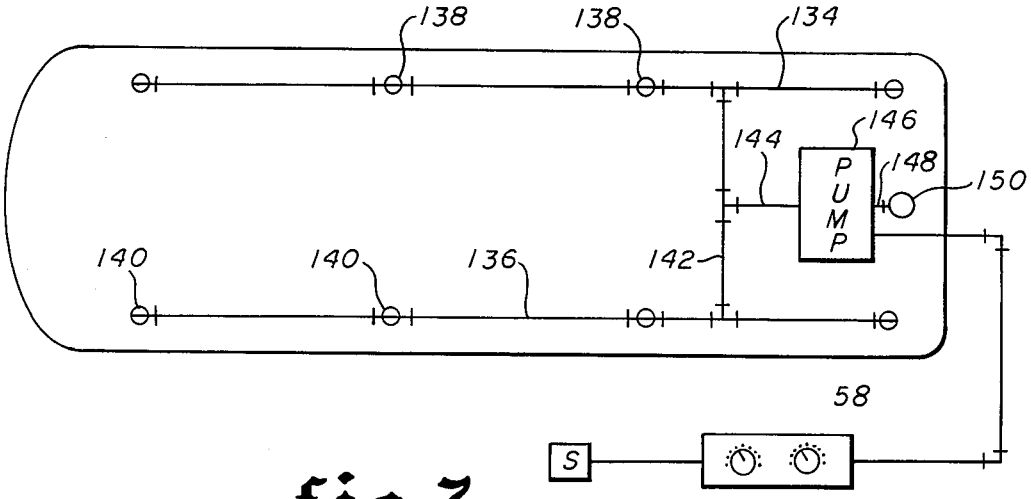
FIG. 7 is a plan view of a conventional bathtub having a portable therapeutic water massage mechanism located therein, said mechanism including a pump intended to be submerged within the water located in the bathtub and representing a further modified embodiment of the present invention.

As shown in FIG. 7, another embodiment is illustrated wherein the water distribution conduit portion and the pump, including its suction and discharge conduits, are adapted to be submerged within the water contained within the bathtub. As shown in FIG. 7, conduit sections 134 and 136 are provided, each having a plurality of depending water distribution conduits having nozzles 138 and 140 which may be generally identical as compared to the structure illustrated in FIG. 1. A transverse manifold conduit 142 is interconnected with the water distribution conduits 134 and 136 and is also in fluid communication with the discharge conduits 144 of the pump. The pump 146 is adapted to be located within the bathtub in submerged or nonsubmerged condition and includes a water suction conduit 148 having a suction inlet 150 through which water is drawn from the bathtub into the pump. The electrical control device 58 for operation of the pump is located outside of the bathtub structure for control by the user.

It may also be desirable to maintain the temperature of the water ejected from the jets at a particular desired temperature. One suitable means for accomplishing temperature control of the water distributed by the jets may conveniently take the form illustrated in FIG. 6 where a heater device 152, which may be an inline heater, is shown to be interconnected within the water discharge conduit 50. A conductor 154 connects the heater 152 with the electrical control device 158 thereby allowing the user to control the heat of the ejected water simply by appropriate adjustment of the control device.

Figure 8:
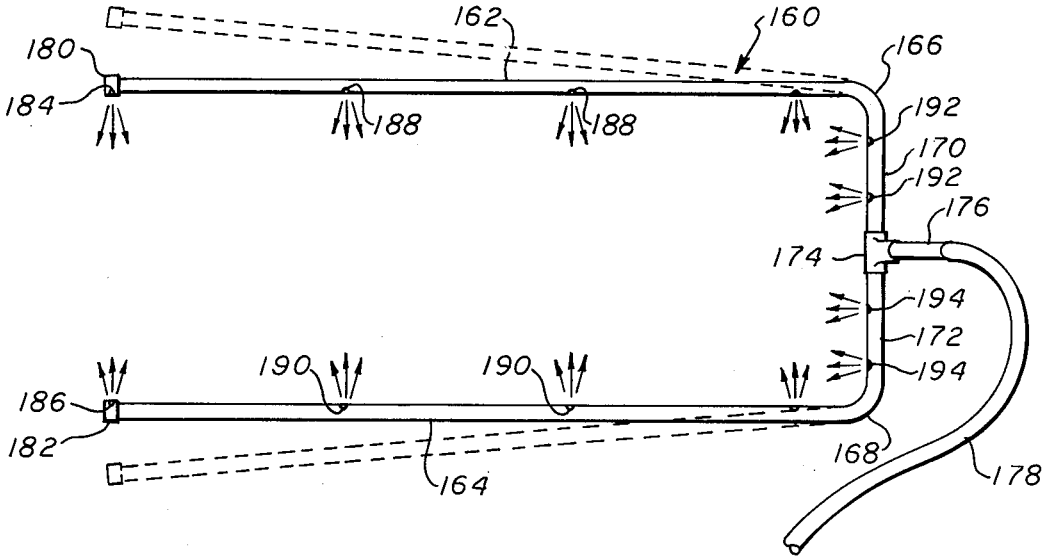
FIG. 8 is a plan view of a water massage distribution system representing a modified, simplified embodiment of the invention.

The invention may also take the form illustrated in FIG. 8 where a water massage mechanism is shown to include a water distribution portion generally at 160 comprising a pair of elongated water distribution conduits 162 and 164 having bends 166 and 168 adjacent the respective ends thereof. Transverse end portions 170 and 172 of the water distribution conduits 170 and 172 are each connected to a tee element 174. To the tee element is connected a water supply conduit 176, a portion 178, which may be formed of flexible material such as a suitable plastic material. The free extremities of the water distribution conduits 162 and 164 are closed by means of cap elements 180 and 182 having water jet apertures 184 and 186 formed respectively therein. Water jet apertures 188 and 190 are formed respectively in the conduits 162 and 164 and are located in spaced relation along the length of the water distribution to direct jets of water at specific portions of the anatomy, such as the hips, knees and ankles of the user. Other water jets, such as at 192 and 194, are located in the transverse portions 170 and 172 of the conduits and serve to direct jets of water at the feet of the user.

Prior to insertion into a conventional bathtub, the water distribution structure of FIG. 8 is slightly diverged, as shown in broken line, spacing the capped extremities slightly greater than the width of a conventional bathtub. During insertion of the structure 160 into a bathtub, the capped extremities are forced toward one another sufficiently to clear the inside wall surfaces of the bathtub. When released, the capped ends will spring outwardly and engage the walls of the bathtub, thus securing the structure within the tub without any physical retaining connection therewith. When the tubular conduit is formed of a material such as plastic plumbing pipe, it will be sufficiently resilient to be readily deformed for simple and easy insertion into the bathtub.

The flexible and yieldable nature of the water distribution structure shown in FIG. 8 effectively promotes portability and usefulness of the invention by adapting the water massage mechanism for various size bathtubs. If suction cups are desired to facilitate connection of the structure 160 to the inside walls of a bathtub, such can be readily added to the structure in the manner illustrated in FIGS. 1, 2 and 5.

In view of the foregoing it is readily apparent that the present invention provide a novel portable water massage mechanism that may be simply and efficiently used by persons for therapeutic purpose or for simple muscle relaxation. The mechanism is completely portable and may be transported from place to place as desired, enabling the user to provide therapeutic treatment during times of travel. The mechanism is adapted for use in conjunction with conventional bathtubs thereby promoting efficient and effective use of the mechanism in most homes and commercial lodging establishments. The mechanism of the present invention is therefore well adapted to attain all of the objects and features hereinabove set forth together with other features that are obvious and inherent from a description of the apparatus. The particular embodiments described herein are described solely for the purpose of facilitating a complete understanding of the spirit and scope of this invention. It is not intended that any of the embodiments disclosed herein be restrictive of the spirit and scope of this invention, it being obvious that the invention may take other convenient forms as appropriate within the scope of this invention.

What is claimed is:

1. A portable therapeutic water massage handling mechanism for use in conjunction with conventional bathtubs, said mechanism comprising:

pump means having suction conduit means and discharge conduit means, said suction conduit means adapted to terminate in the water of said bathtub, allowing said pump to withdraw water from said bathtub;

a pair of elongated water distribution conduits adapted to be removably positioned in spaced relation within said bathtub and being extendable along the inner side walls of said bathtub;

a plurality of water jets being positioned in spaced relation along the length of each of said water distribution conduits for directing jets of water toward specific parts of the anatomy of a person within said bathtub; and connection means interconnecting said discharge conduit means and said water distribution conduit means, whereby water discharged from said pump is conducted to said water distribution conduit means.

2. A therapeutic water massage means as recited in claim 1, wherein:

said water distribution conduits are adapted to be submerged within water in said bathtub and high velocity water exiting said jets creates therapeutic water turbulence in the immediate vicinity of each of said jets for causing water massaging of said person.

3. A therapeutic water massage means as recited in claim 1, wherein:

said water discharge conduits are positionable within said bathtub so as to direct said jets at the joints of said person.

4. A therapeutic water massage means as recited in claim 1, wherein said connection means comprises:

an elongated manifold conduit having a connection intermediate the extremities thereof, said intermediate connection receiving said discharge conduit of said pump; and terminal connection means being defined at each extremity of said manifold conduit said terminal connection means being interconnected with respective ones of said water distribution conduits.

5. A therapeutic water massage means as recited in claim 1, wherein said mechanism includes:

heating means in said pump discharge conduit means causing heating of water being pumped through said discharge conduit means.

6. A therapeutic water massage means as recited in claim 1, wherein:

at least some of said water jets are directionally adjustable, whereby said person is enabled to adjust the direction of water being discharged from said jets to obtain desired therapeutic effect.

7. A therapeutic water massage means as recited in claim 1, wherein said mechanism includes:

valve means for at least some of said jets, whereby the person utilizing said mechanism is enabled to vary the velocity of water being discharged from said jets and shut off the flow of water from said jets as desired.

8. A therapeutic water massage means as recited in claim 1, wherein:

at least one linear adjustment is provided for said water distribution conduit means.

9. A portable water massage mechanism for use in conjunction with conventional bathtubs, said mechanism comprising:

means for withdrawing water from said bathtub, pressurizing said water and transporting said pressurized water to said bathtub;

a water distribution mechanism being positionable within said bathtub and receiving said pressurized water, said water distribution mechanism defining distribution sections extending along the walls defining the foot and side walls of said bathtub;

water jet means being defined by said foot and side wall portions of said water distribution mechanism, said water jet means directing jets of water into said bathtub.

10. A portable water massage mechanism as recited in claim 9, wherein:

said water distribution mechanism is of generally U-shaped configuration defining a transverse portion interconnecting a pair of elongated side portions, said side portions being normally located in diverging relation and being yieldable to conform to the internal size of a conventional bathtub.

* * * * *